US012789952B2

(12) United States Patent
Mayall

(10) Patent No.: US 12,789,952 B2
(45) Date of Patent: Nov. 10, 2026

(54) RECOVERY RAMP

(71) Applicant: OFFSHORE SURVIVAL SYSTEMS LIMITED, Denbigh (GB)

(72) Inventor: Samuel Mayall, Denbighshire (GB)

(73) Assignee: Zelim Limited, Denbighshire (GB)

( * ) Notice: Subject to any disclaimer, the term of this patent is extended or adjusted under 35 U.S.C. 154(b) by 541 days.

(21) Appl. No.: 18/276,287

(22) PCT Filed: Feb. 8, 2022

(86) PCT No.: PCT/GB2022/050338
§ 371 (c)(1),
(2) Date: Aug. 8, 2023

(87) PCT Pub. No.: WO2022/167825
PCT Pub. Date: Aug. 11, 2022

(65) Prior Publication Data

US 2024/0300621 A1 Sep. 12, 2024

(30) Foreign Application Priority Data

Feb. 8, 2021 (GB) ..... 2101724

(51) Int. Cl.
*B63B 27/14* (2006.01)
*B63B 27/22* (2006.01)
(Continued)

(52) U.S. Cl.
CPC ..... *B63B 27/143* (2013.01); *B63B 27/22* (2013.01); *B63B 83/00* (2020.01); *B63C 9/28* (2013.01)

(58) Field of Classification Search
CPC ..... B63B 27/143; B63B 27/22; B63B 83/00; B63B 27/36; B63B 35/44; B63B 35/00;
(Continued)

(56) References Cited

U.S. PATENT DOCUMENTS 2,568,330 A 9/1951 Flippin
3,596,623 A * 8/1971 Frankel ..... B63B 27/143 114/259
(Continued)

FOREIGN PATENT DOCUMENTS

CN 210503082 5/2020
GB 1585865 3/1981
(Continued)

OTHER PUBLICATIONS

Dredgers of Ukraine Water harvester DRW-81D Datasheet [online]., dredgers.com.ua 2021 [archived on Jan. 16, 2021]. Retrieved from the Internet: <URL: https://web.archive.org/web/20210116061702/https:/ /dredgers.com.ua/en/water-harvester/ >. (Year: 2021).*
(Continued)

*Primary Examiner* — Lars A Olson
*Assistant Examiner* — Eric Anthony Starck
(74) *Attorney, Agent, or Firm* — Bay State IP, LLC

(57) ABSTRACT

A man-over-board recovery ramp for fitting to a boat, comprising: a mounting adapted to be fitted to the boat, the mounting defining a pivot axis; a first conveyor section connected to the mounting and arranged to pivot around the pivot axis; and conveyor means on the first conveyor section for drawing a man-over-board up the ramp.

24 Claims, 13 Drawing Sheets

(51) Int. Cl.
*B63B 83/00* (2020.01)
*B63C 9/28* (2006.01)

(58) Field of Classification Search
CPC .. B63B 35/32; B63C 9/28; B63C 9/02; B63C 9/00; B63C 9/22; B63C 2009/085; B63C 2009/265; A01K 80/00; A01K 5/0208; A01D 44/00; A01D 61/02; A01D 57/20
See application file for complete search history.

(56) References Cited

U.S. PATENT DOCUMENTS

| | | | | |
|---|---|---|---|---|
| 9,376,175 | B1 * | 6/2016 | Karafiath | B63B 25/008 |
| 2006/0065586 | A1 * | 3/2006 | Walczyk | E02B 15/048 210/242.1 |
| 2008/0202405 | A1 * | 8/2008 | Kern | B65G 17/064 114/259 |
| 2010/0147782 | A1 * | 6/2010 | Newman | A01D 44/00 210/241 |
| 2017/0320550 | A1 | 11/2017 | Ryan | |
| 2020/0283101 | A1 | 9/2020 | Konig | |
| 2021/0229784 | A1 * | 7/2021 | Mayall | G05D 1/227 |

FOREIGN PATENT DOCUMENTS

| | | | |
|---|---|---|---|
| WO | 2012007002 | 1/2012 | |
| WO | 2018165714 | 9/2018 | |
| WO | 2019158904 | 8/2019 | |
| WO | WO-2019158904 A1 * | 8/2019 | B63B 27/143 |

OTHER PUBLICATIONS

WO-2019158904-A1 text (Year: 2019).*
Communication under Rule 71(3) EPC, European Patent Office, Jun. 23, 2025.
International Search Report European Patent Office, May 31, 2022.
Written Opinion ISA, European Patent Office, May 31, 2022.
Combined Search & Examination Report, UK Intellectual Property Office, Jul. 19, 2022.

* cited by examiner

RECOVERY RAMP

CROSS REFERENCE TO RELATED APPLICATION

This application is for entry into the U.S. National Phase from which priority is claimed under all applicable sections of Title 35 of the United States Code including, but not limited to, Sections 120, 363, and 365(c) to International Application No. PCT/GB2022/050338 filed on Feb. 8, 2022, and which in turn claims priority under 35 USC 119 to Great Britain Patent Application No. 2101724.9 filed on Feb. 8, 2021.

The present invention relates to a man-over-board recovery ramp.

WO 2019/158904 discloses an unmanned lifeboat that has a hull with a transom opening, a fo'c'sle closed by a rounded top deck, providing accommodation for survivors. The aft deck is generally U-shaped with a cut-out open at the transom, which is vestigial with two small port and starboard parts. Within the cut-out is a boarding assistance ramp. This is level with the aft deck at its forward end and slopes down to the transom. It extends aft of this by a few of feet to enable survivors to swim and crawl onto it.

For guidance to reach the vicinity of the survivors, the lifeboat is equipped with a communication apparatus including a receiver for receiving survivor location data. In addition, the navigation apparatus with which the lifeboat is equipped includes a GPS system of its own, a compass. The lifeboat is also equipped with a control system. The latter computes a course to the survivors by comparing its and survivor positions. The control unit has an output module for controlling the propulsion units to drive the lifeboat to the survivor position, making a final approach at slow speed. The control system is also programmed to perform a search around a last known survivor position in case they cannot be otherwise located, taking account of dead reckoning due to wind and tide.

Ramps for man-over-board recovery find application in boats not normally thought of as lifeboats. Therefore, as used herein, the term "boat" is used to signify water craft including but not limited to life boats, safety/standby boats, pilot boats, fishing boats, crew transfer boats and the like.

It may be desirable to provide a man-over-board recovery ramp for a boat, to be retrofitted or otherwise fitted to the boat.

In a first aspect, the invention provides a man-over-board recovery ramp for fitting to a boat, comprising: a mounting adapted to be fitted to the boat, the mounting defining a pivot axis; a first conveyor section connected to the mounting and arranged to pivot around the pivot axis; and conveyor means on the first conveyor section for drawing a man-over-board up the ramp. Various optional features of this aspect are set out in the dependent claims.

According to the invention in another aspect there is provided a man-over-board recovery ramp for fitting to a boat, comprising:

- a mounting adapted to be fitted to the boat, the mounting defining a pivot axis,
- a first conveyor section pivotally attached to the mounting at the pivot axis at a proximal end of the first conveyor section,
- a second conveyor section pivotally attached to the first conveyor section about a second pivots axis at the distal end of the first and proximal end of the second, whereby the conveyor sections can lie close to each other when not deployed,

- means for restricting angular movement of the conveyor sections away from lying close to each other to relative orientations wherein they extend away from each other,
- means for normally stowing the conveyor sections lying close to each other and extending upwards of the mounting and for releasing them for deployment to a position in which the first conveyor section slopes downwards from the mounting and the second conveyor section extends away from the first and
- conveyor means on both conveyor sections for drawing a casualty up the ramp.

The conveyor means on the conveyor sections will normally be one or more belts running around rollers at the ends of the sections. The belts can be a plurality of individual belts arranged edge wise across the sections or a single belt extending across the width of each or both sections. The belts may have casualty engaging slats.

Whilst we can envisage that the ramp may be provided with a hand wheel or the like, we expect normally to provide means for powering the conveyors. The power means can be a motor mounted on the mounting and drivingly connected to the belts via the rollers. We prefer to use a motor arranged internally of at least one of the rollers. The rollers at the distal end of the first ramp and the proximal end of the second ramp can be drivingly connected for powering of the second ramp's belt. Where the first section has a motor internal to a roller, the second can also, dispensing with the need for driving connection between the belts.

Alternatively to providing individual motors for the individual sections, or drivingly connecting the belts on the individual sections, we prefer to arrange the belt run at the pivot between the two sections such that a single belt is able to run on both conveyor sections.

We can envisage that, at least in initial production, the ramp is normally lashed upright and able to deploy by gravity under control of a winch, with the distal end of the second conveyor section having buoyancy for its support in the water. In such arrangement, we prefer to provide a spring, such as a gas strut, to urge the second section from lying against the first. Alternatively, the sections can be provided with a linkage, whereby as the first section deploys towards the water angling away from its upright stowage position, the second section is deployed with an opposite angle.

Whilst gravity deployment is simple, we prefer the control of powered deployment under the control of a powered actuator, possibly a powered winch. This arrangement allows for ready return to the stowage position after use or service.

It should be noted that the man-over-board may be over-board from the boat fitted with the man-over-board recovery ramp or another boat, vessel, ship, craft or structure or indeed anyone in distress in the water.

The ramp is envisaged to be retrofitted to an existing boat but can be fitted during building of the boat.

It is envisaged that normally the mounting will be fitted with the pivot axis athwart-ships at the stern of the boat, but other orientations and positions are envisagaeble.

The mounting will usually be a unitary mounting, but may be a pair of independent fittings such as plumber blocks adapted to be fitted separately to the boat. Normally the mounting will be fitted to the deck of the boat. Alternatively the mounting may be movably stowed spaced from a deployment position centrally of a transom of the boat For instance the mounting may be arranged on rails to sideways with the stowed ramp from position against stern rails to port or starboard of the a central board position in the stern rails.

Again the mounting and the stowed ramp may be stowed against a port or starboard side rail and pivotally connected to a post common to stern rails and side rails, with the ramp being pivotal to its transom deployment position. Whilst it is preferred that the deployment position is amidships, this need not be so.

To help understanding of the invention, certain embodiments thereof will now be described by way of example only and with reference to the accompanying drawings, in which.

Figure 1:
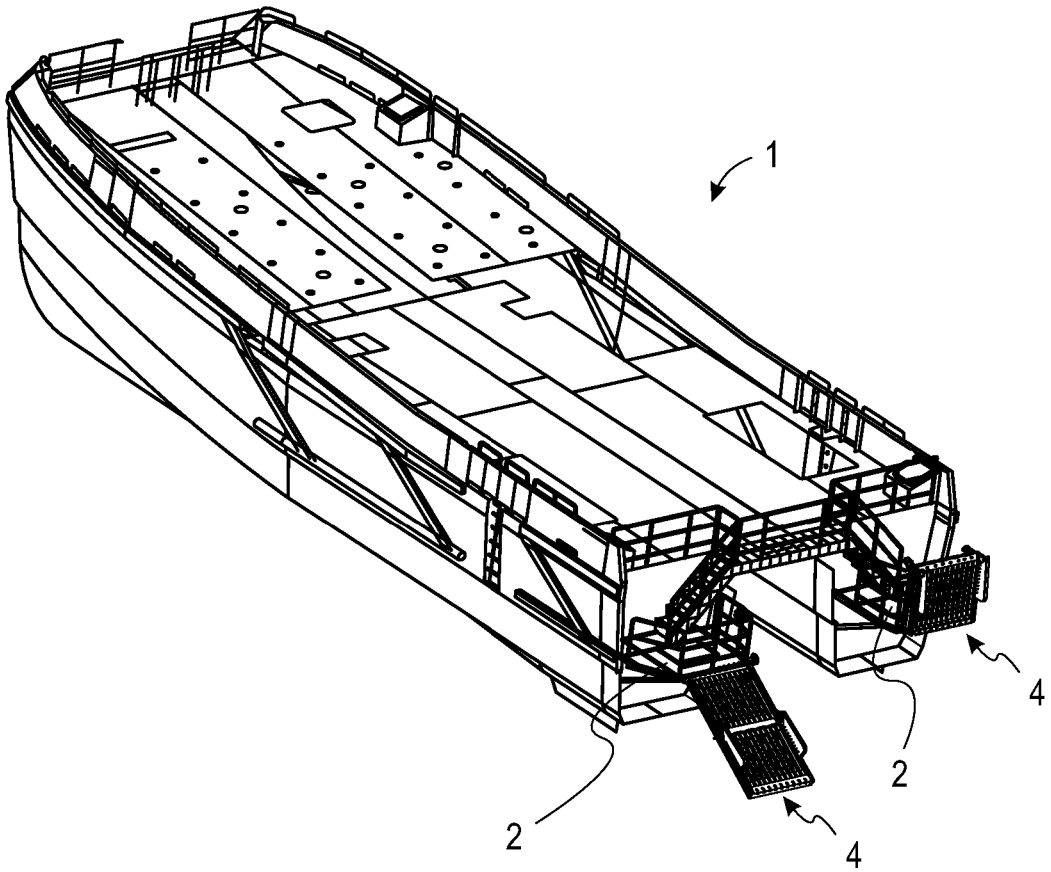
FIG. 1 is a perspective view of a hull equipped with two exemplary man-over-board recovery ramps of the invention.
Figure 2:
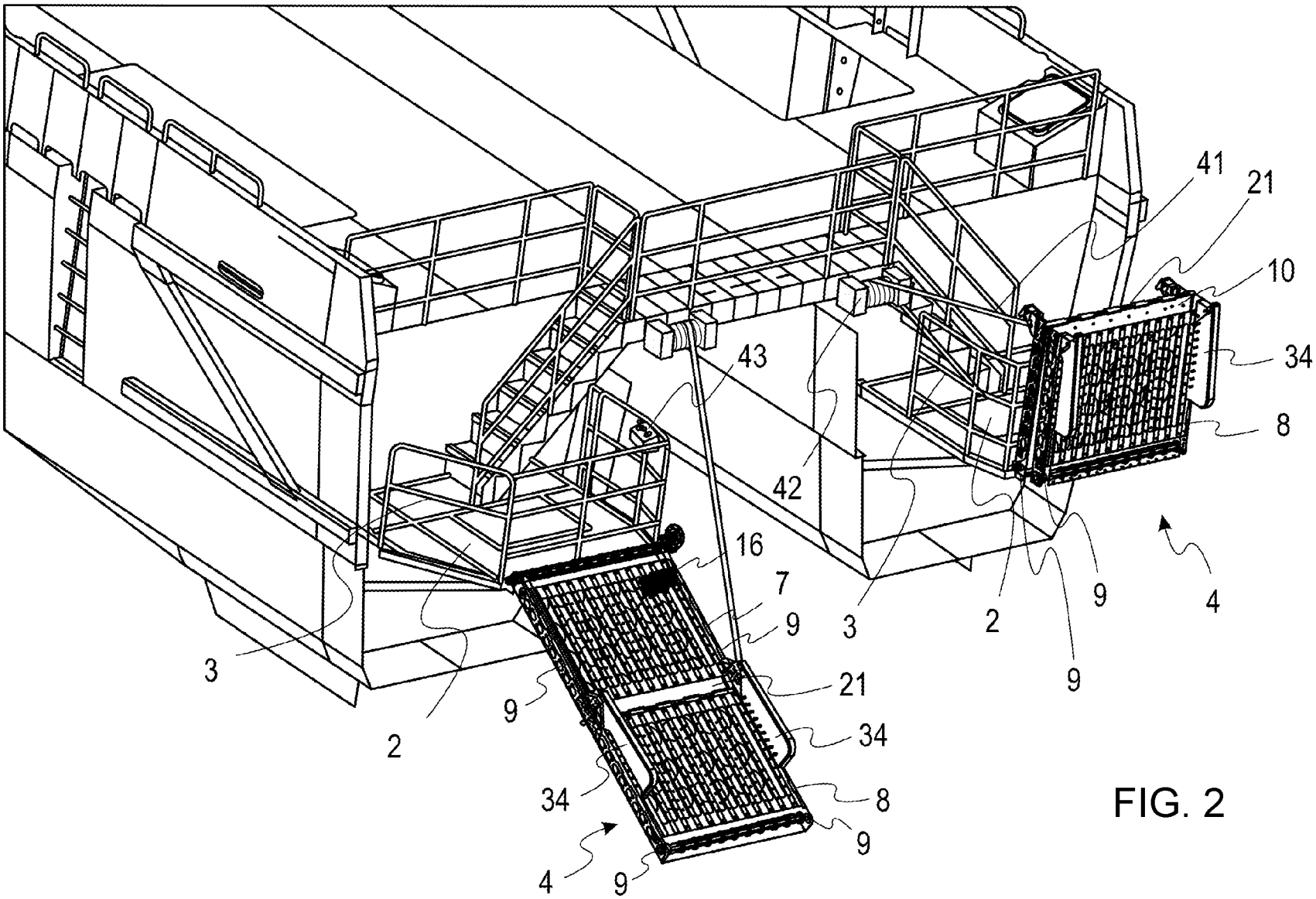
FIG. 2 is a more detailed view of the ramps on the stern of the hull.
Figure 3:
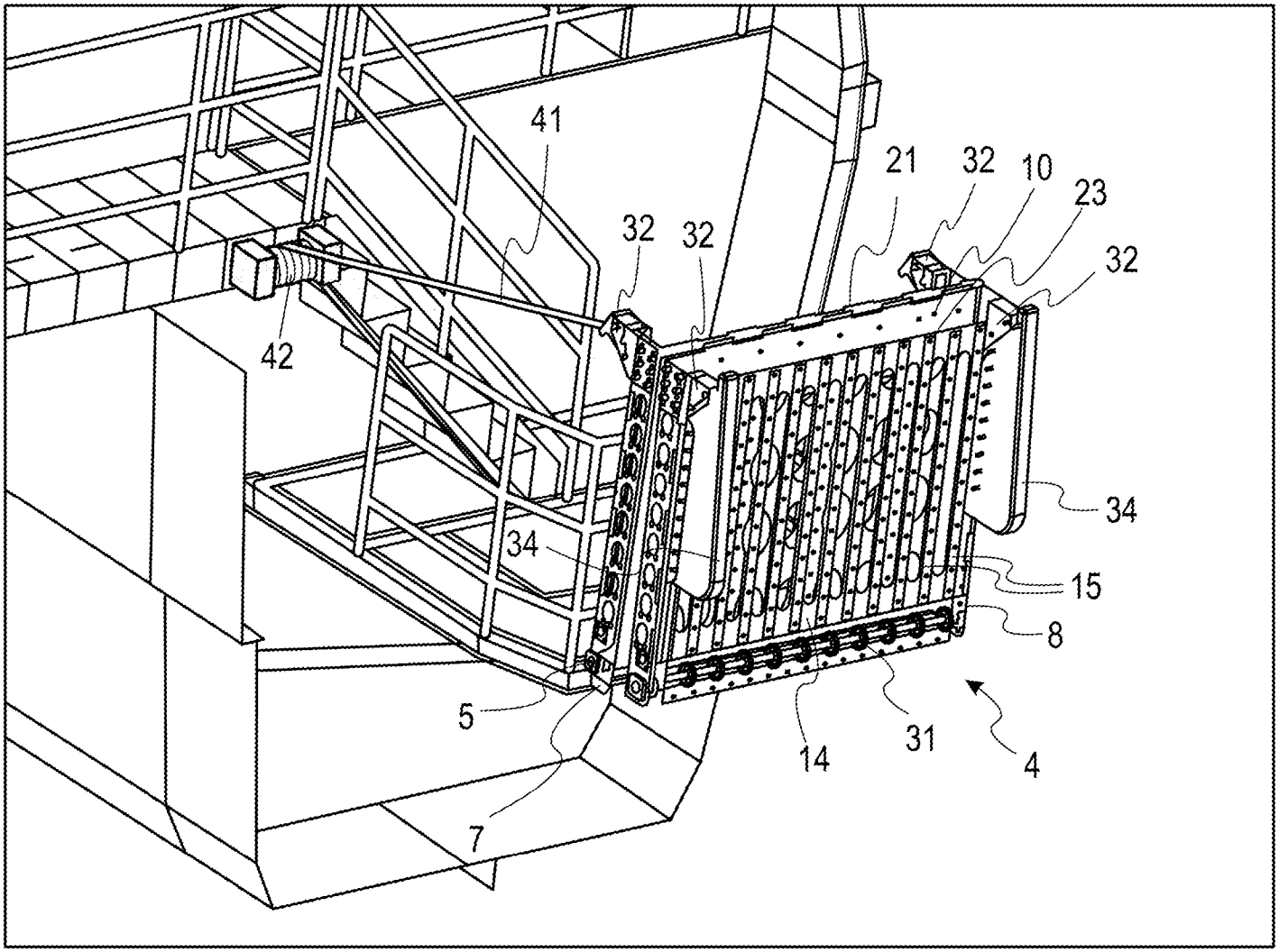
FIG. 3 is a further detailed view of the starboard side, stowed ramp.
Figure 4:
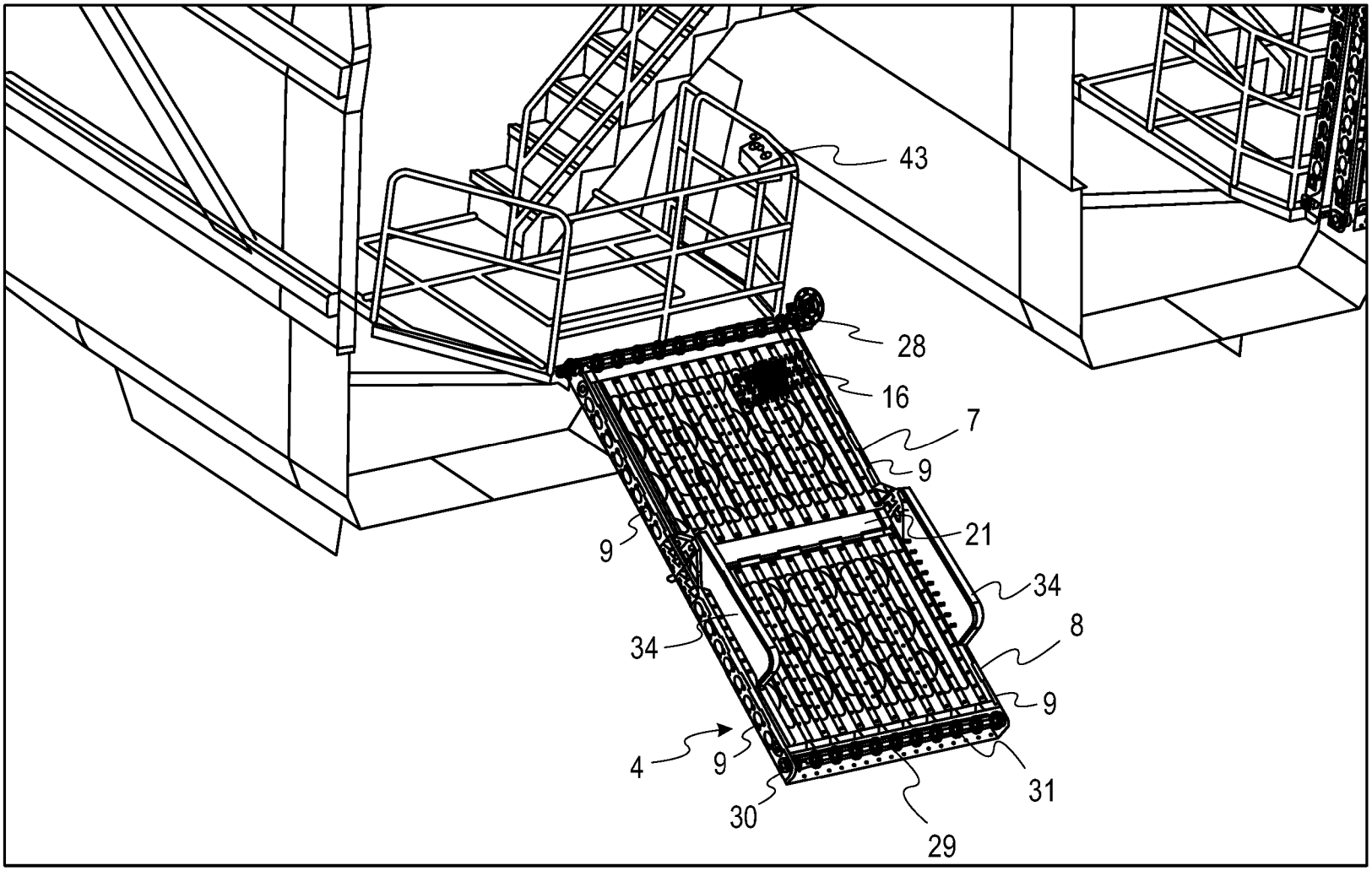
FIG. 4 is a similar view of the port side, deployed ramp.
Figure 5:
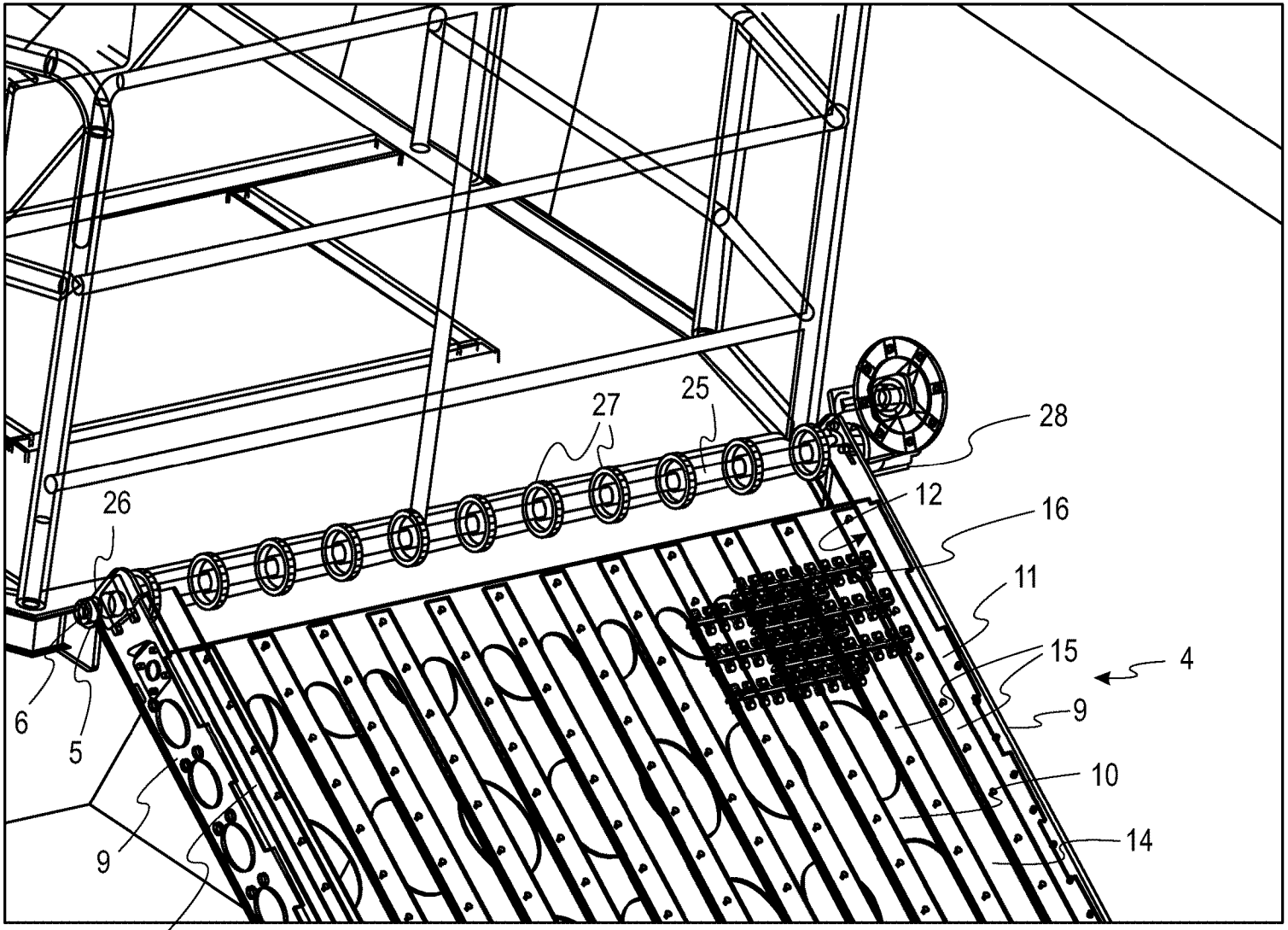
FIG. 5 is a more detailed view of mounting and drive arrangements for the port ramp.
Figure 6:
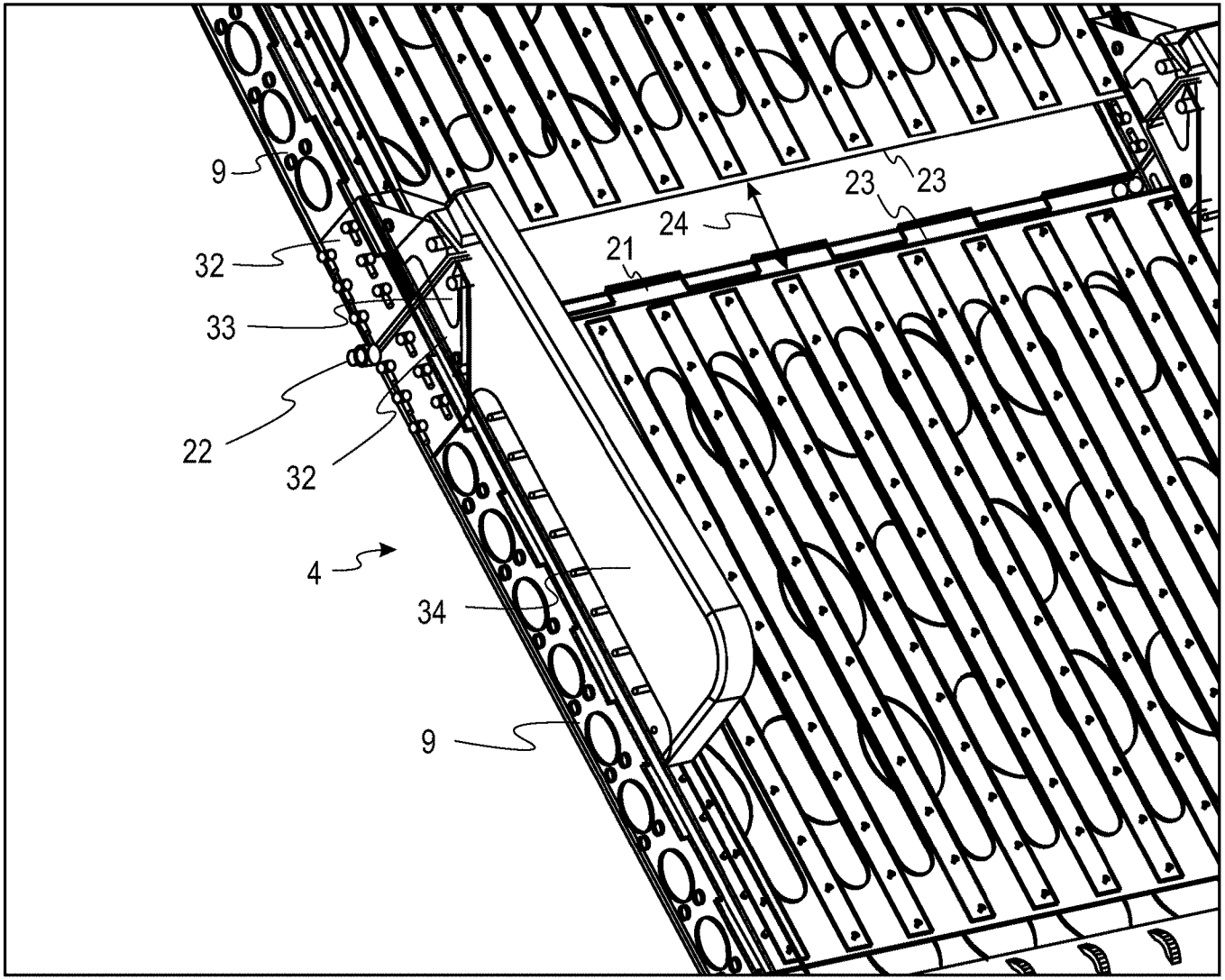
FIG. 6 is a more detailed view of hinge and buoyancy arrangements for the port ramp.
Figure 7:
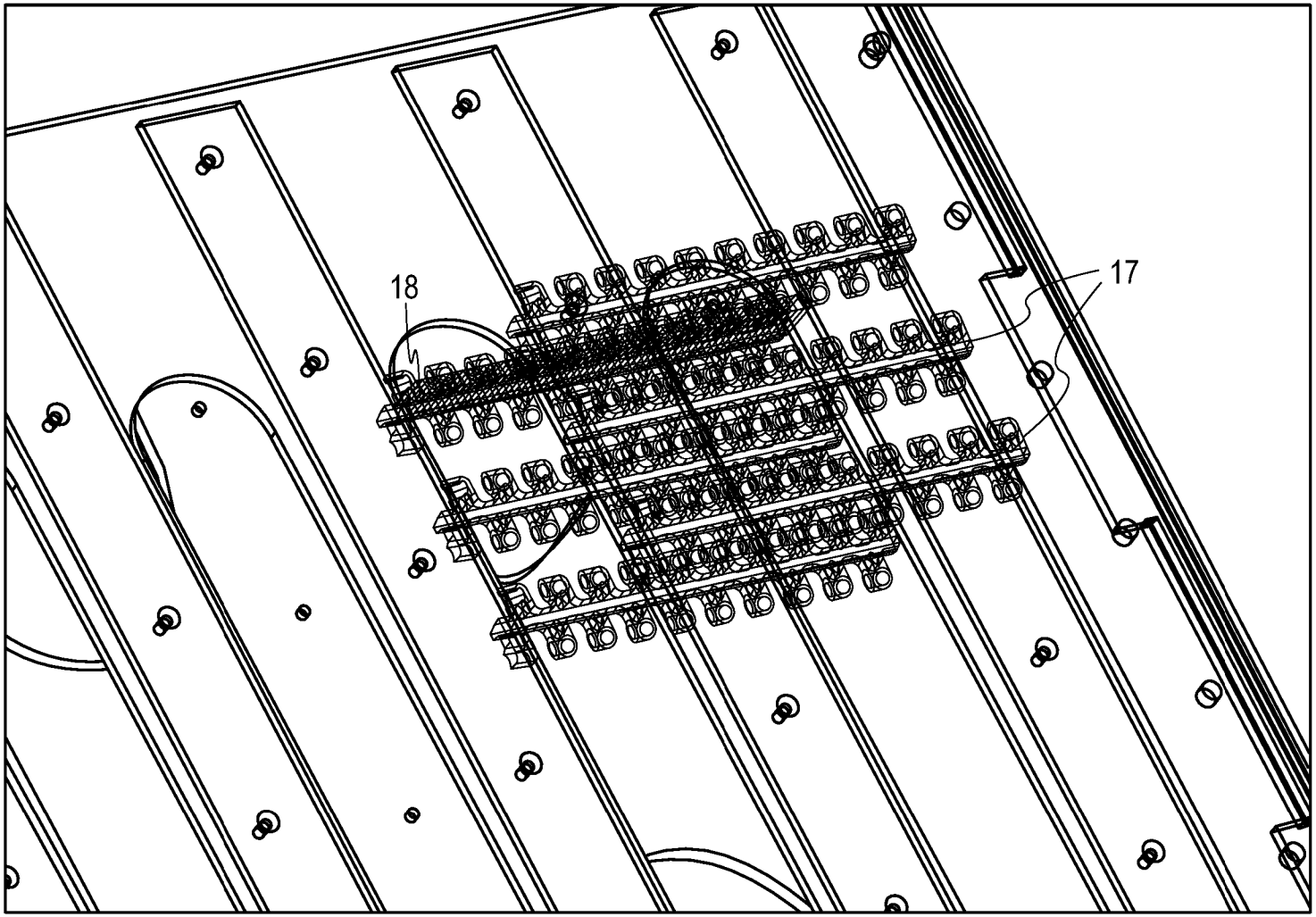
FIG. 7 is a scrap view of part of a belt on the port ramp.
Figure 8:
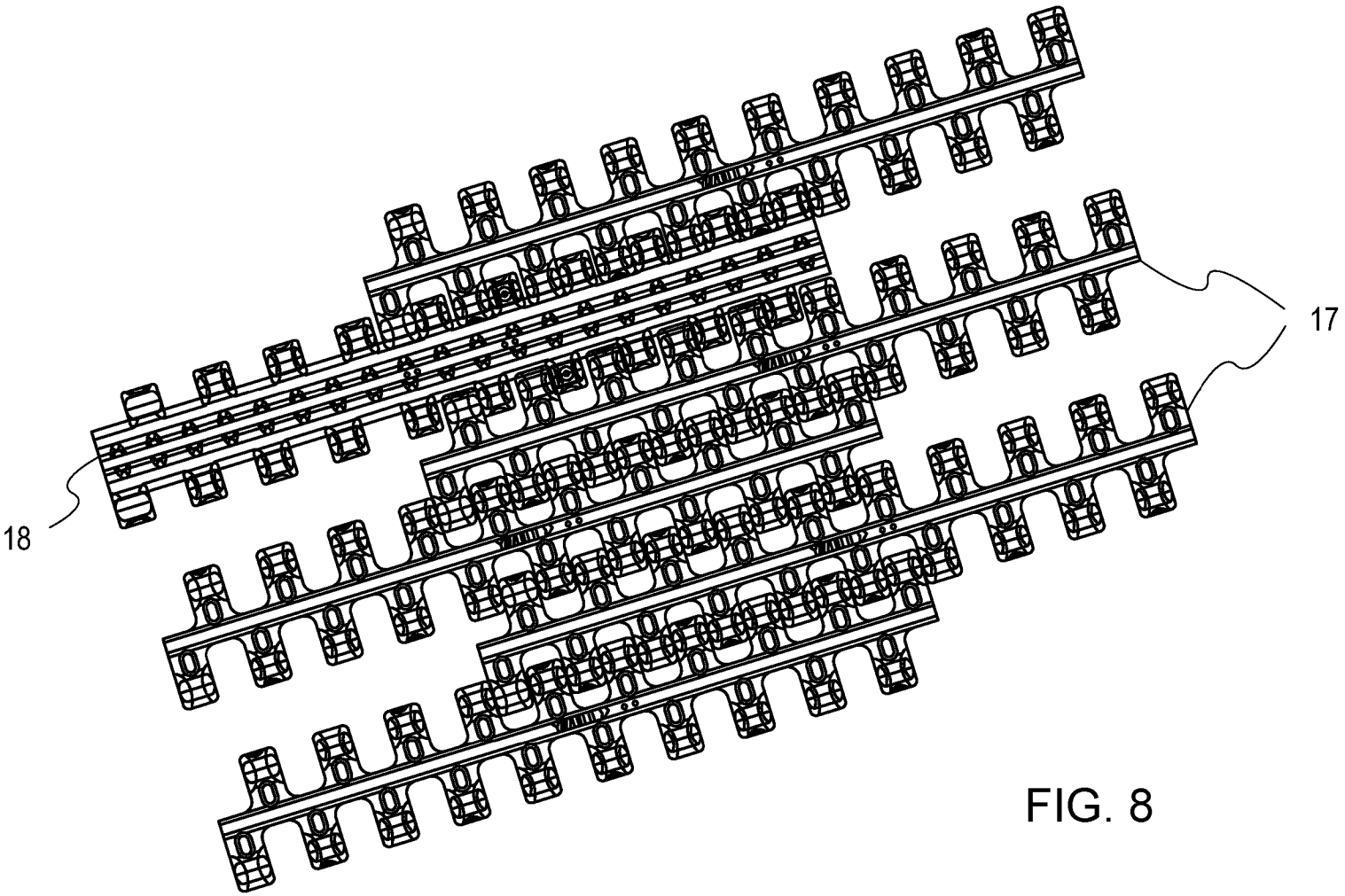
FIG. 8 is a perpendicular view of the part of the belt.
Figure 9:
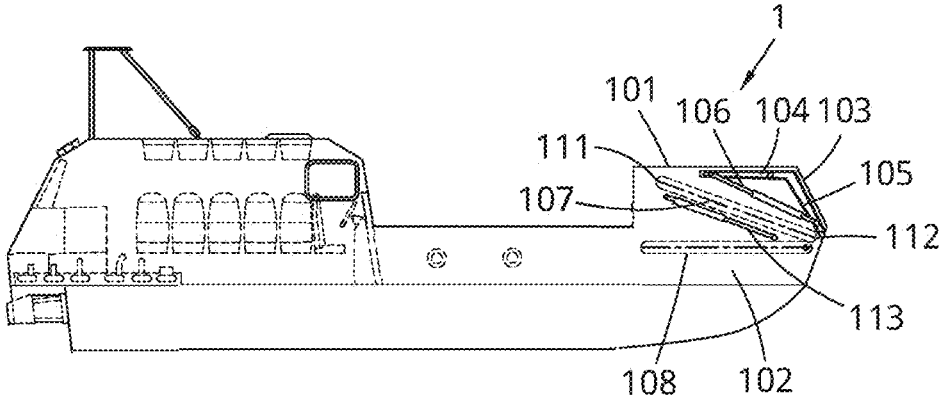
FIG. 9 is an amidships side elevation of a life boat with a man-over-board recovery ramp stowed therein.
Figure 10:
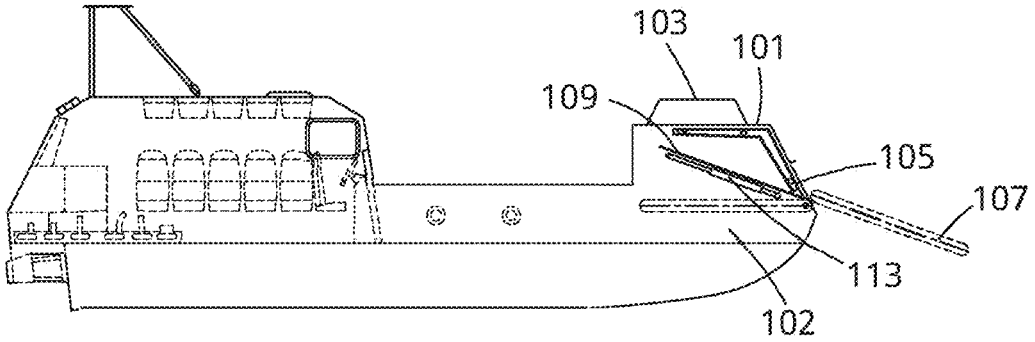
FIG. 10 is a similar view to FIG. 9 but with the man-over-board recovery ramp deployed.

Referring to FIGS. 1 to 8, a hull 1 of a boat such as a crew transfer catamaran has two jet protection platforms 2 aft with railings 3. Man-over-board recovery ramps 4 are fitted to both, one ramp 4 (left hand side in FIG. 1) being shown deployed and the other ramp 4 (right hand side in FIG. 1) stowed. They are connected to the platforms 2 via plumber blocks 5, which are fitted fitted to corners of the platforms 2, and shafts 6 engaged in the plumber blocks 5 that are fixed to a first 7 of two conveyor sections 7,8 of each ramp 4.

The sections 7,8 are generally similar, each having pressed steel side members 9 with a lower (in use) panel 10 fixed between the side members 9. The lower panel 10 is apertured for lightness. Upper flanges 11 on the side members 9 extend in and define a belt run channel 12 with an upper panel 14 fast between the side members 9. The upper panel 14 has low-friction strips 15 for a belt 16 to slide on. The belt 16, shown only partially in FIGS. 1 to 8, is comprised of interdigitated, hinged pieces 17, some of which have slat members 18 standing up from the belt 16. The lower panel 10 may have similar low-friction strips for the belt 16 to slide on via the slat members 18.

At the distal end of the first section 7 and the proximal end of the second section 8, the conveyor sections 7, 8 are connected with hinge formations 21 which attach to respective lower panels 10. A shaft 22 extends through the hinge formations. To avoid stretching of the belt 16, when the ramp 4 is stowed, the upper panels 14 have spaced ends 23, leaving a gap 24, into which the belt 16 can "cut the corner".

The proximal end of the first section 7 has a shaft 25 running in plumber blocks 26 on the side members 9 and having belt engagement sprockets 27. A belt drive motor 28 is provided at one end of the shaft 25. The distal end of the second section 8 has a similar shaft 29, with bearings 30 and sprockets 31.

At the hinge formation 21, the side members 9 have hinge-stop plates 32 fixed to each of the side members 9. They are arranged to prevent the conveyor sections 7, 8 sagging at the hinge formation 21 when the ramp 4 is deployed. The hinge-stop plates 32 carry latches 33 for holding the conveyor sections 7, 8 in alignment once deployed. The side members 9 of the second conveyor section 8 are provided with buoyant guides 34 extending along the side members 9 from the hinge formation 21. The buoyant guides 34 perform the twin functions of holding the ramp 4 from sinking straight down when deployed and guiding a casualty being retrieved up the ramp 4 from falling off sideways or hanging up on the hinge-stop plates 32.

Normally the ramps 4 will be in the stowed position as is the case for the ramp 4 on the right hand side of FIG. 1, with the distal end of the second conveyor section 8 lashed (not shown) to the railings 3. The ramp 4 is held in its upright position by a cable 41 shackled to a side member 9 of the first conveyor section 7 and wound on a winch 42 at the top of steps down to the platform 2. For use of the ramp 4, the lashings are cut and the cable 41 is paid out. The ramp 4 deploys to the position of the ramp 4 as shown on the left hand side of FIG. 1. A control box 43 is installed on the railings 3, via which the drive motor 28 can be switched on to draw the run of the belt 16 on top of the upper panels 14 which can be used to draw a casualty onto the ramp 4 and inboard to the platform 2.

The distal end of the upper conveyor section 7 may be provided with further buoyancy whereby it is supported with the very end of the first conveyor section 7 just below the surface of the water for engagement below casualties and drawing them onto the conveyor 7.

Referring now to FIGS. 9 to 12, a man-over-board recovery ramp 107 as fitted to a life boat 1 is shown. The forrard end of the lifeboat 1 has a fo'c'sle 101, providing cover over the fore deck 102. At the bow, the fo'c'sle 101 has an aft-inclined door 103 guided on runners 104, 105 to the side and top of the fo'c'sle so that door can be opened in an up and over manner (further details of which can be seen in FIGS. 11 and 12). Telescopic actuators 106 are provided for opening the door 103 to expose a deployable man-over-board recovery ramp 107 and the fore deck 102 or at least a secondary ramp 108 on the fore deck within the fo'c'sle 101. Below the runners 104, 105, further runners 109 are provided for the aft end of the deployable recovery ramp 107. Along its side edges, it has other runners (not shown). The aft end of the ramp 107 has rollers 111 engaging in the runners 109 and at the bow, rollers 112 mounted at the forrard corners of fore deck 102 engage in the runners on the recovery ramp 107. Actuators 113 extend along the runners 109 and engage the recovery ramp at its rollers 111.

After opening of the door 103, operation of the actuators 113 deploys the recovery ramp 107 to bring the rollers 111 forward into a position that the rollers 112 would have been whilst the recovery ramp 107 is in a stowed position. The rollers 112 are thrust overboard from the lifeboat 1 during deployment, which in turn induces a pivoting of the recovery ramp 107 about a pivot axis defined at the fitting (i.e. mounting) of the recovery ramp 107 to the life boat 1 such that the rollers 112 at the forward most end of the recovery ramp 107 extend to sea. The motor (not shown) of the recovery ramp 107 can then be operated to drive the recovery ramp 107 for conveying a casualty aboard the lifeboat 101.

Figure 11:
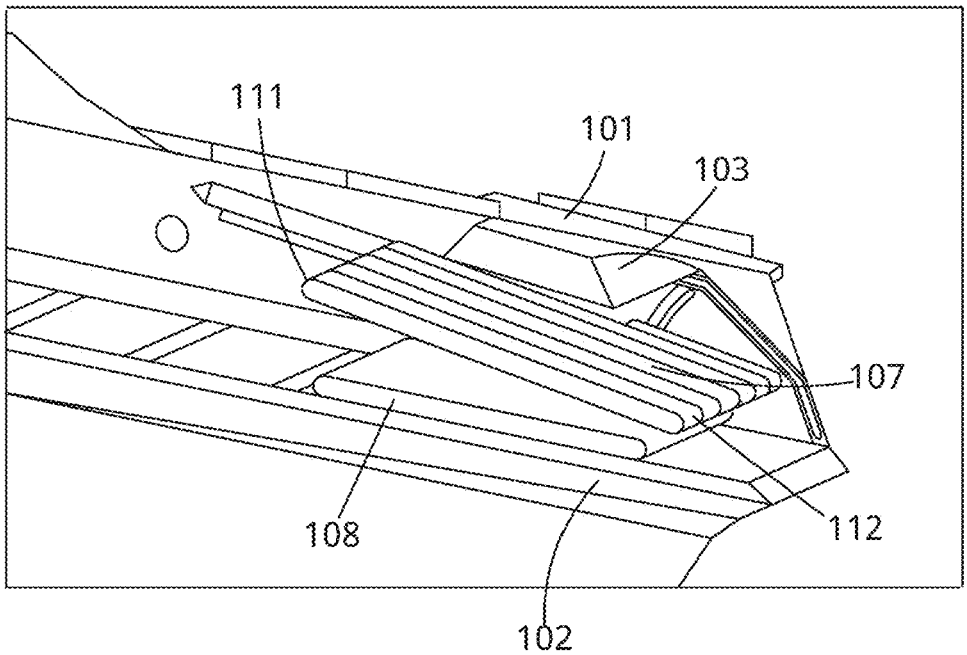
FIG. 11 is an enlargement of the bow detail of FIGS. 9 and 10 showing the man-over-board recovery ramp in an on-board position once the bow door has been opened.

FIG. 11 shows the bow region of the fore deck 102 in more detail. The upper deployable recovery ramp 107 is guided in C-shaped supports at its forrad and aft ends by rollers 111, 112. The forrad C-shaped supports may be mounted to pivot through cooperation with slots in side plates on either side. In this way, the deployable ramp can slide forwards and then pivot to lower the forrad end of the deployable ramp 107 into the water once the bow door 103 has been opened and pivoted over the top of the fore deck 102. Once deployed, the aft end of the deployable recovery ramp 107 may substantially align with the forrad end of the secondary ramp 108, to help convey a survivor afterwards onto the fore deck 102 and further into the life boat 1, e.g. into an accommodation or cockpit of the lifeboat 1.

Figure 12:
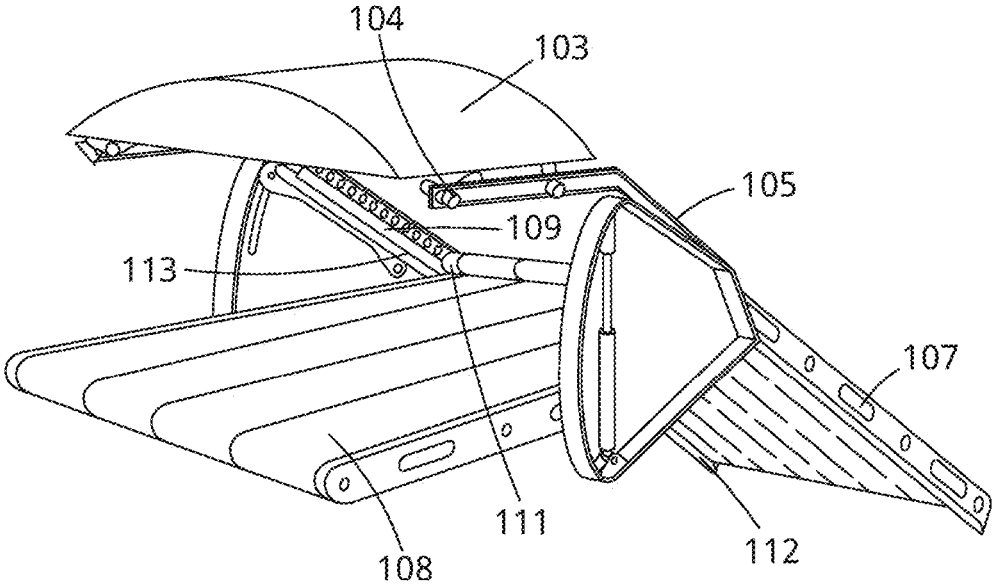
FIG. 12 shows the recovery ramp of FIG. 11 in a deployed position, extending from the bow of the life boat.
Figure 13:
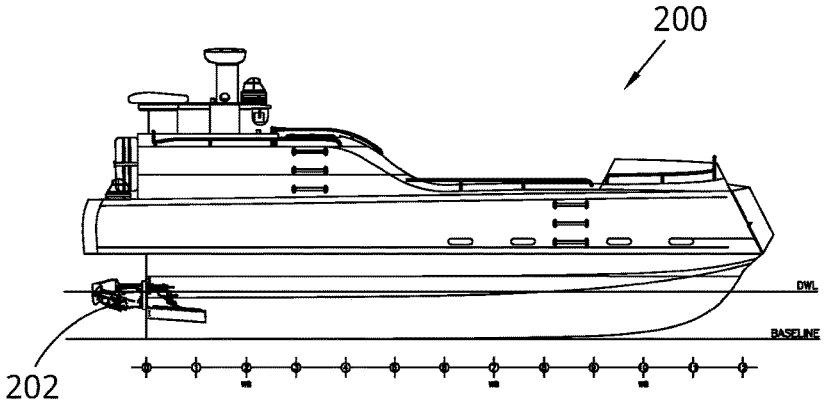
FIG. 13 is a side view of a life boat comprising a man-over-board recovery ramp.
Figure 14:
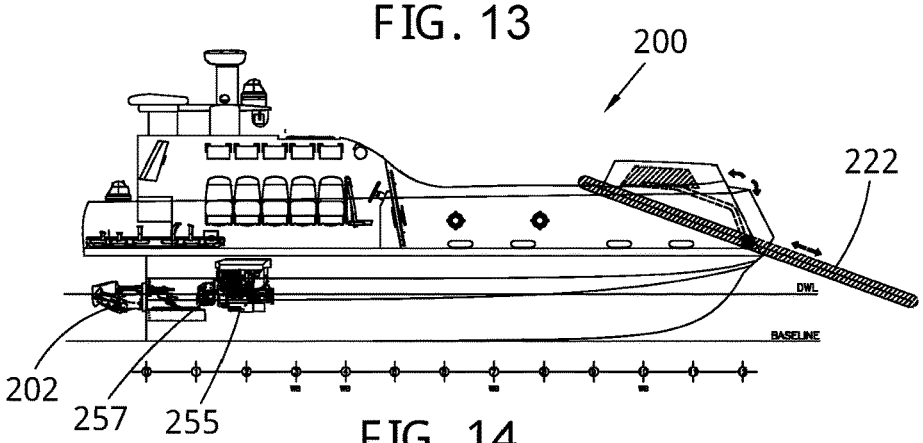
FIG. 14 is a part cross-sectional view of the life boat in FIG. 13 showing interior features of the life boat and the recovery ramp in a deployed position.
Figure 15:
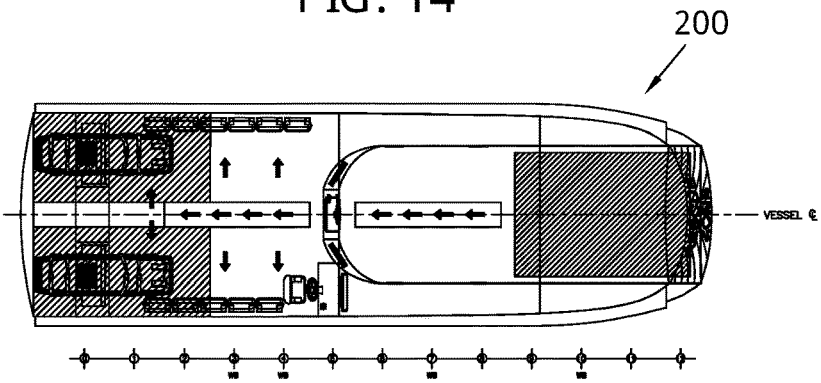
FIG. 15 is a plan view of the life boat shown in FIG. 14 with the recovery ramp stowed and the bow door closed.
Figure 16:
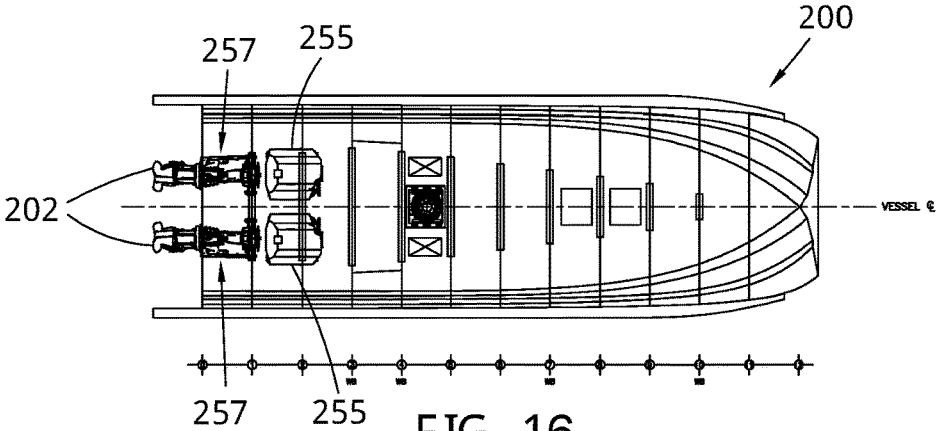
FIG. 16 is a below deck view similar to FIG. 15 showing the internal structure of the life boat.
Figure 17:
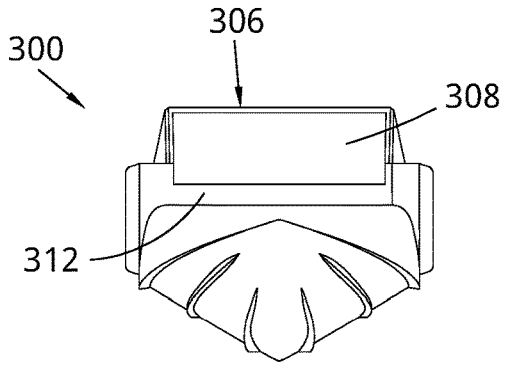
FIG. 17 is a bow view of a life boat comprising a man-over-board recovery ramp.
Figure 18:
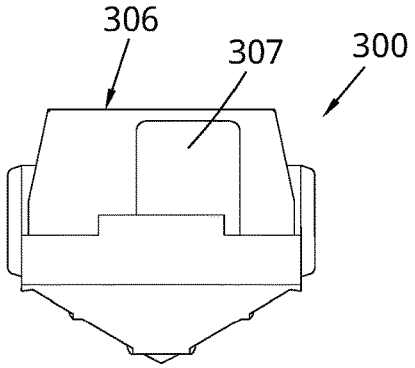
FIG. 18 is a stern view of the life boat shown in FIG. 17.
Figure 19:
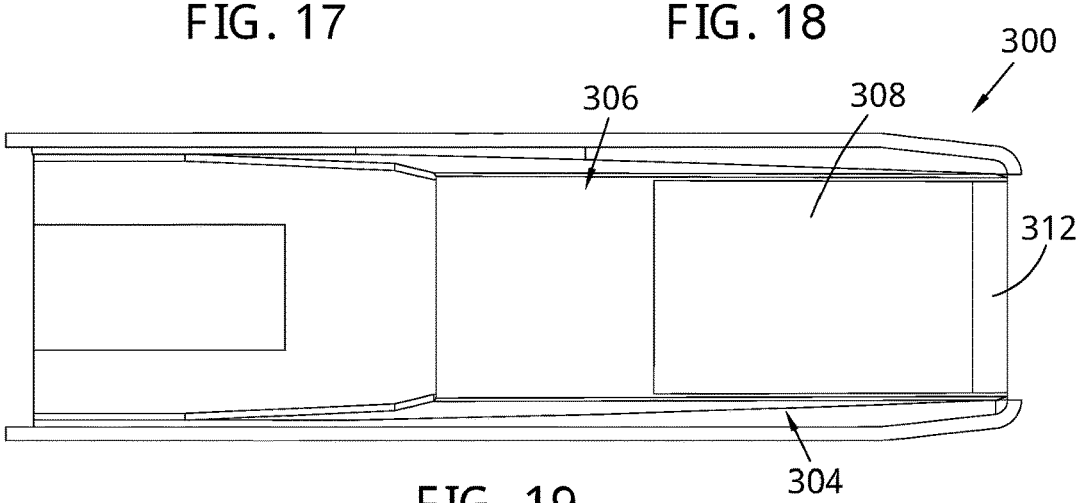
FIG. 19 is a plan view of the life boat shown in FIG. 17.
Figure 20:
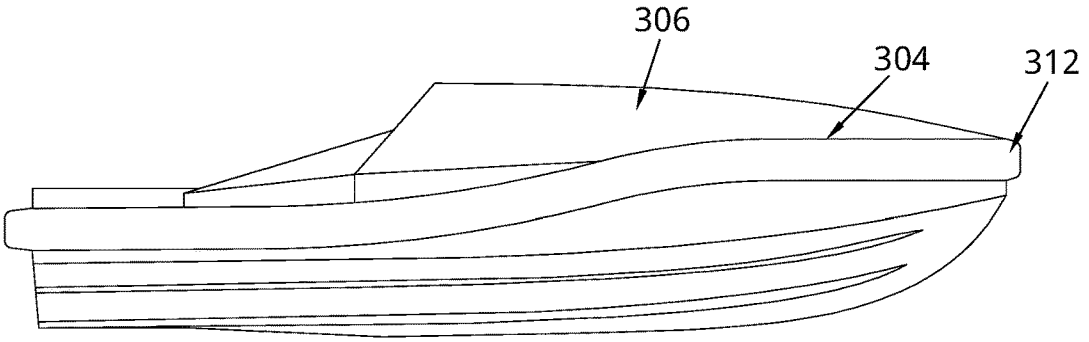
FIG. 20 is a side view of the life boat shown in FIG. 17.
Figure 21:
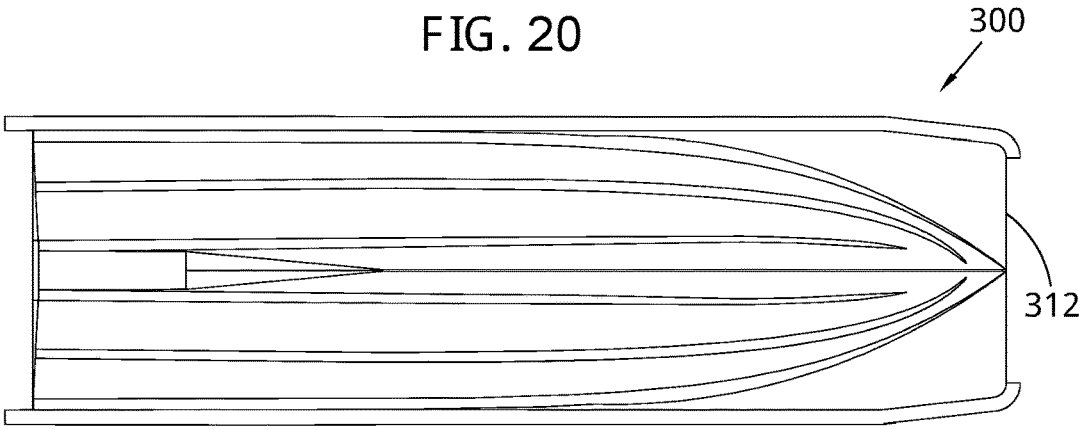
FIG. 21 is an underside view of the life boat shown in FIG. 17.

FIG. 12 shows more details of the deployable ramp 107 in a deployed position with the detail of the life boat 1 omitted.

The deployable ramp 107 and the secondary ramp 108 may be constructed in a similar manner with an apertured structure to allow water to pass through. The conveyors may also comprise a plurality of belts as shown. The belts may be provided with width-wise slats to assist with drawing the survivor on-board.

FIGS. 13 to 16 shows an alternative life boat 200. The life boat 200 shares many similarities with the life boat 1 depicted in FIGS. 9 to 12.

The primary difference between the life boat 200 and the life boat 1 of FIGS. 9 to 12 reside in their respective propulsion means and the nature of their recovery ramps.

The lifeboat 200 of FIGS. 13 to 16 comprises two inboard, diesel powered motors 255 that are each drivingly connected to a respective gearbox 257 and, in turn, a propeller 202. The propellers 202 act to propel the life boat 202, and these are powered by the two inboard, diesel powered motors 255.

The life boat 200 further comprises man-overboard-recovery ramp 222. The recovery ramp 222 is angled relative to the life boat 200 and is linearly translatable through the bow door of the life boat 200, once opened, between a stowed position and a deployed position. This is in a manner comparable to the deployment of the recovery ramp 107 of FIGS. 9 to 12. Actuators (not shown) are arranged to deploy and retract recovery ramp 222 between the stowed and deployed position. In the deployed position, the forrard end of the ramp is arranged to extend to or through the waterline of the boat 200. In the stowed position, the entire recovery ramp 222 is housed within the fore deck of the life boat 200 such that the bow doors can be closed to provide an at least partially enclosed and weather protected space at the fore deck in which the recovery ramp 222 is held. The recovery ramp 222 is mounted onto the boat 200 in a manner that permits a pivotal movement (as limited by the dimensions of the opening at the bow door) such that the angle of the recovery ramp 222 relative to the boat 200 can increase or decrease as required to reach a deployed position. This has the effect that the forrard end of the recovery ramp 222 can be raised and lowered further than is permitted simply by linear translation of the recovery ramp 222. The recovery ramp 222 comprises a conveyor comprises belts and a motor comparable in arrangement to those described above in relation to recovery ramp 107.

FIGS. 17 to 21 show a further alternative lifeboat 300. The lifeboat comprises an accommodation area 306 that occupies the foredeck 304 of the lifeboat 301. The accommodation area has a hatch 307 for entry to the accommodation area 306. Situated above and covering the accommodation area 306 is a retractable shutter door 308. The shutter door 308 is retractable from the bow 312 of the life boat 300 such that, in a retracted position, the bow 312 is open and a man-over-board recovery ramp 322 (see FIG. 22) that is housed within the accommodation area 306 just below the shutter door is exposed to an exterior of the lifeboat 300. Whilst the shutter door 308 is in the retracted position, the recovery ramp 322 is capable of being deployed from its stowed position (i.e. housed in the accommodation area 306) and through the open bow 312 through linear and pivotal movement of the recovery ramp 322 relative to the remainder of the boat 300 (e.g. in a manner comparable to that described above in connection with recovery ramp 222) such that the recovery ramp 322 can extend to or through the water line to permit rescue of overboard persons-a deployed position. Such persons can be brought on-board the lifeboat 300 via the recovery ramp 322 to the accommodation area 306 where they are able to take refuge.

After deployment (and optionally after overboard persons have been recovered), the recovery ramp 322 can be retracted to a stowed position (e.g. as shown in FIGS. 13 to 17) at which time, the shutter door 308 can be closed to enclose and provide weather protection to the accommodation area 306.

Figure 22:
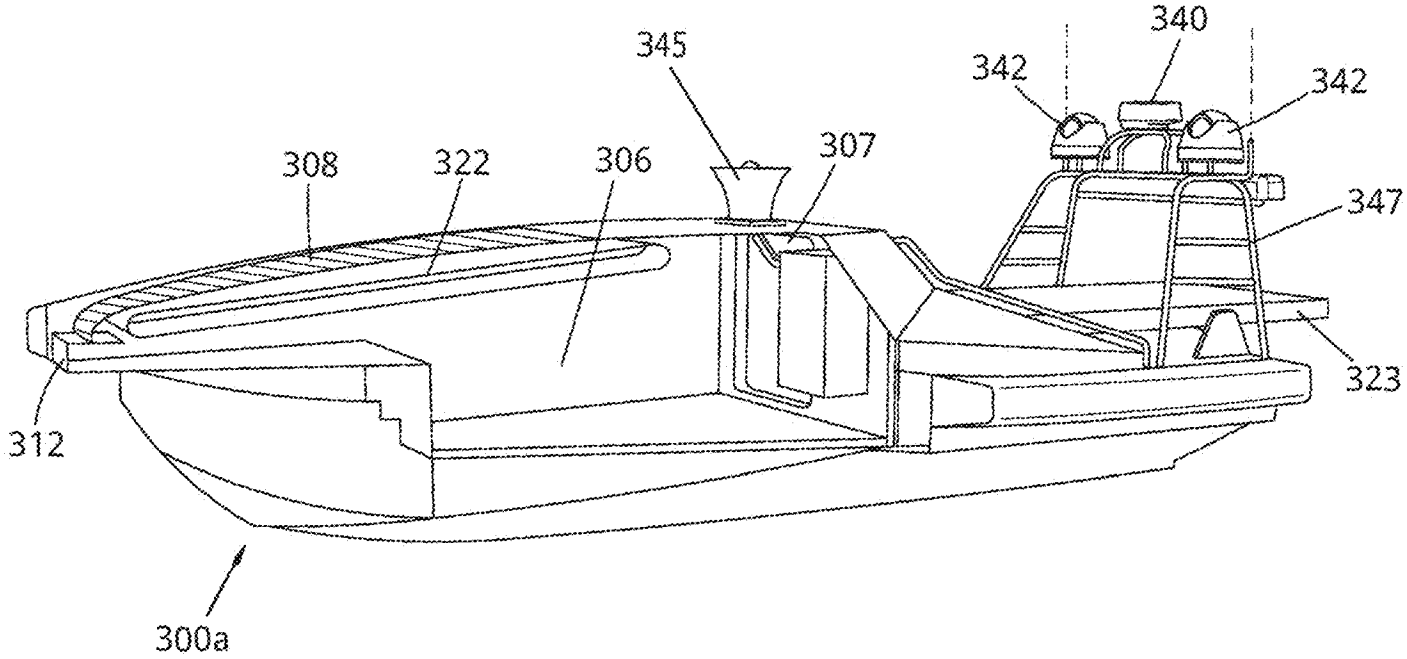
FIG. 22 shows a modified form of the life boat of FIG. 17.

FIG. 22 shows a modified version of the lifeboat 300 of FIGS. 17 to 21, denoted **300*a*. The lifeboat 300*a* comprises all of the same features as lifeboat 300, and in fact further detail of the shutter door 308, recovery ramp 322 and survivor pod 306 that are common to both the life boat 300 and the life boat 300*a* can be seen FIG. 22. The life boat 300*a* further comprises a search horn 345 fitted atop the accommodation area 306, and a gantry 347 fitted with antennas 340 and cameras 342 for communication and search purposes. An additional recovery ramp 323 is also mounted at a stern of the life boat 300. The recovery ramp 323 is deployable and retractable in a manner comparable to recovery ramp 322 and provides an alternative means for rescue of overboard personnel. Such personnel can access the accommodation area 306 via hatch 307**.

The invention is not intended to be restricted to the details of the above described embodiment. For instance, the distal end of the upper conveyor may be provided with buoyancy whereby it is supported with the very end of the conveyor just below the surface for engagement below casualties and drawing them onto the conveyor.

Certain optional aspects of the invention, which may or may not be claimed, but which may form the basis for future amendments and/or for one or more future divisional application(s), continuation application(s) and/or continuation-in-part application(s), are set out in the following clauses.

CLAUSES

1. A man-over-board recovery ramp for fitting to a boat, comprising:
   a mounting adapted to be fitted to the boat, the mounting defining a pivot axis;
   a first conveyor section connected to the mounting and arranged to pivot around the pivot axis; and
   conveyor means on the first conveyor section for drawing a man-over-board up the ramp.
2. A man-over-board recovery ramp according to clause 1, wherein the recovery ramp is arranged to pivot around the pivot axis to a deployed position.
3. A man-over-board recovery ramp according to clause 2, wherein in the deployed position a distal end of the recovery ramp is configured to extend to or through the waterline of the boat to which the ramp is to be fitted to thereby permit drawing of a casualty in the water up the ramp.
4. A man-over-board recovery ramp according to clause 2 or 3, wherein the first conveyor section is slidably connected to the mounting or wherein the mounting is configured to be slidably connected to the boat such that the recovery ramp is slidable into a stowed position.
5. A man-over-board recovery ramp according to clause 4, wherein the recovery ramp is arranged to slide and pivot in unison/in concert/simultaneously as it moves from the stowed position and into the deployed position.
6. A man-over-board recovery ramp according to clause 4 or 5, wherein the recovery ramp is prevented from pivoting around the pivot axis whilst the ramp is in the stowed position.
7. A man-over-board recovery ramp according to clause 4, 5 or 6, wherein the mounting is configured to be arranged on rails on the boat which enables the recovery ramp to slide into the stowed position.
8. A man-over-board recovery ramp according to any of clauses 4 to 7, wherein in the stowed position the recovery ramp is configured to be stowed, either wholly or partly, within a footprint of the boat to which the ramp is to be fitted.
9. A man-over-board recovery ramp according to any of clauses 2 to 8, wherein the recovery ramp is arranged to pivot to the deployed position and/or from the stowed position under the effect of gravity.
10. A man-over-board recovery ramp according to clause 9, comprising a winch that is arranged to control the recovery ramp as it pivots to the deployed position and/or from the stowed position.
11. A man-over-board recovery ramp according to any of clauses 2 to 10, comprising a powered actuator, optionally a powered winch, arranged to control movement of the recovery ramp as it pivots to the deployed position and/or from the stowed position.
12. A man-over-board recovery ramp according to clause 11, comprising a controller configured to control the powered actuator, wherein the controller is manually, remotely or automatically operable.
13. A man-over-board recovery ramp according to any preceding clause, wherein a (the) distal end of the recovery ramp is provided with buoyancy arranged to maintain the distal end of the recovery ramp at a predetermined depth in the water in the deployed position.
14. A man-over-board recovery ramp according to any preceding clause, wherein a (the) distal end of the recovery ramp is provided with ballast arranged to maintain the distal end of the recovery ramp at a predetermined depth in the water in the deployed position.
15. A man-over-board recovery ramp according to any preceding clause, wherein the ramp comprises isolation means for isolating motion of a distal end of the recovery ramp from motion of the boat to which the ramp is to be fitted.
16. A man-over-board recovery ramp according to clause 15, wherein the means for isolating motion comprises one or more floatation devices attached to or forming part of the recovery ramp and configured to support the distal end of the recovery ramp in the water.
17. A man-over-board recovery ramp according to clause 15 or 16, wherein the isolation means comprises:
   a controller;
   at least one motion sensor in communication with the controller; and
   at least one actuator in communication with the controller and arranged to control a position of the distal end of the recovery ramp whilst in the deployed position;
   wherein the at least one motion sensor is arranged to sense motion of the boat to which the ramp is to be fitted and/or the remainder of the ramp and to communicate the sensed motion to the controller; and
   wherein the controller is arranged to control the at least one actuator in response to the sensed motion and to maintain a substantially static position of the distal end of the whilst in the deployed position.
18. A man-over-board recovery ramp according to any of clauses 15 to 17, wherein the isolation means comprises a coupling connecting the mounting and the first conveyor section and/or a coupling configured to connect the mounting and the boat, the coupling(s) permitting relative movement between the recovery ramp and the mounting and/or configured to permit relative movement between the mounting and the boat.
19. A man-over-board recovery ramp according to clause 18, wherein the coupling(s) comprises bearings that enable the relative movement.
20. A man-over-board recovery ramp according to clauses 18 or 19, wherein the coupling(s) is/are each a telescopic coupling.
21. A man-over-board recovery ramp according to any preceding clause, wherein the recovery ramp is configured be retrofitted to an existing boat.
22. A man-over-board recovery ramp according to any of clauses 1 to 20, wherein the ramp is configured be integrated with the boat during its construction.
23. A man-over-board recovery ramp according to any preceding clause, wherein the ramp is configured to be fitted to one of a life boat, a safety/standby boat, a pilot boat, a fishing boat, or a crew transfer boat.
24. A man-over-board recovery ramp according to any preceding clause, wherein the conveyor means and first conveyor section are dimensioned to permit recovery of at least one person at a time, optionally two or more people at a time.
25. A man-over-board recovery ramp according to clause 24, wherein the conveyor means and the conveyor section have a size of at least 1.5 metres in a direction that is parallel to the distal and proximal ends.

26. A man-over-board recovery ramp according to any preceding clause, wherein the recovery ramp has an open or aperture structure which permits water to flow through the ramp.
27. A man-over-board recovery ramp according to any preceding clause, wherein the conveyor means comprises projections extending from a surface of the conveyor means
28. A man-over-board recovery ramp according to clause 27, wherein the projections form one or more chevron shapes across the surface of the conveyor means.
29. A man-over-board recovery ramp according to any preceding clause, wherein the conveyor means is arranged to create a current in the water when used to help draw a casualty up the recovery ramp, wherein the current urges a casualty in the water towards the recovery ramp.
30. A man-over-board recovery ramp according to any preceding clause, wherein the material of the conveyor means is advantageously tacky or otherwise has an enhanced frictional surface.
31. A man-over-board recovery ramp according to any preceding clause, wherein the conveyor means comprises one or more belts running around rollers provided at the proximal and distal ends of the first conveyor section.
32. A man-over-board recovery ramp according to clause 31, wherein the belt(s) are a plurality of individual belts arranged edge wise across the first conveyor section or a single belt extending across a width of the first conveyor section that is parallel to the proximal and distal ends.
33. A man-over-board recovery ramp according to clause 31 or 32, comprising at least one motor internal to at least one roller, the at least one motor configured to power the conveyor means.
34. A man-over-board recovery ramp according to any preceding clause, comprising a motor for powering the conveyor means into movement.
35. A man-over-board recovery ramp according to clause 34, wherein the motor is mounted on the mounting.
36. A man-over-board recovery ramp according to any of clauses 33 to 35, comprising a control box via which the motor can be activated.
37. A man-over-board recovery ramp according to clause 36, wherein the control box is remotely or automatically operable.
38. A man-over-board recovery ramp according to any preceding clause, wherein the mounting is configured to be fitted with the pivot axis athwart-ship at the stern of the boat or at the bow of the boat.
39. A man-over-board recovery ramp according to any preceding clause, wherein the recovery ramp is configured to be fitted to a boat such that in the deployed position the ramp is amidships.
40. A man-over-board recovery ramp according to any preceding clause, wherein the first conveyor section comprises pressed steel side members.
41. A man-over-board recovery ramp according to clause 40, comprising a panel fixed between the side members of the first conveyor section.
42. A man-over-board recovery ramp according to clause 41, wherein the panel has low-friction surface or strips for a (the) belt(s) to slide on.
43. A man-over-board recovery ramp according to any of clauses 40 to 42, wherein the side members are provided with buoyant guides that extend along the side members.
44. A man-over-board recovery ramp according to any preceding clause, wherein a proximal end of the first conveyor section comprises a shaft and wherein the mounting comprises two plumber blocks through which the shaft runs.
45. A man-over-board recovery ramp according to any preceding clause, wherein the mounting is configured to be fitted to a transom, a gunwale, a deck, a bow or a stern of a boat.
46. A method of recovering a man-over-board using a boat fitted with the man-over-board recovery ramp of any preceding clause, the method comprising:
pivoting the first conveyor section around the pivot axis from the stowed position to the deployed position; and
drawing the man-over-board up the ramp using the conveyor means.
47. A method of fitting a man-over-board recovery ramp according to any of clauses 1 to 45 to a boat, the method comprising securing the mounting to the boat.
48. A method according to clause 47, wherein the method is a method of retrofitting.
49. A method of manufacturing a man-over-board recovery ramp for fitting to a boat, the method comprising:
providing a mounting adapted to be fitted to the boat, the mounting defining a pivot axis;
connecting a first conveyor section having a proximal end and a distal end to the mounting such that the first conveyor section is arranged to pivot around the pivot axis; and
providing conveyor means on the first conveyor section for drawing a casualty up the ramp.
50. A method according to clause 49, resulting in the man-over-board recovery ramp as defined in any of clauses 1 to 45.
51. A vessel comprising the man-over-board recovery ramp according to any of clauses 1 to 45.
52. A vessel according to clause 51, wherein the vessel is a boat, optionally wherein the recovery ramp has been retrofitted or is integrally fitted to the boat
53. A man-over-board recovery ramp according to clause 1, and optionally any preceding clause, wherein the first conveyor section has a proximal end and a distal end, the first conveyor section is pivotally attached to the mounting at the pivot axis at a proximal end of the first conveyor section, and wherein the man-over-board recovery ramp comprises:
a second conveyor section pivotally attached to the first conveyor section about a second pivot axis at the distal end of the first conveyor section and a proximal end of the second conveyor section, whereby the conveyor sections can lie close to each other when not deployed;
means for restricting angular movement of the conveyor sections away from lying close to each other to relative orientations wherein they extend away from each other;
means for normally stowing the conveyor sections lying close to each other and extending upwards of the mounting and for releasing them for deployment to a position in which the first conveyor section slopes downwards from the mounting and the second conveyor section extends away from the first; and wherein the conveyor means on the first conveyor section and a conveyor means provided on the second conveyor section are suitable for drawing a casualty up the ramp.

54. A man-over-board recovery ramp according to clause 53, wherein the conveyor means on both the conveyor sections comprise one or more belts running around rollers at the proximal and distal ends of the conveyor sections.

55. A man-over-board recovery ramp according to clause 54, wherein the belts are a plurality of individual belts arranged edge wise across the conveyor sections or a single belt extending across the width of each or both conveyor sections.

56. A man-over-board recovery ramp according to clause 54 or 55, wherein the belt(s) have casualty engaging slats.

57. A man-over-board recovery ramp according to any of clauses 54 to 56, wherein the rollers at the distal end of the first conveyor section and the proximal end of the second conveyor section are drivingly connected for powering the belt(s) of the second conveyor section.

58. A man-over-board recovery ramp according to any of clauses 54 to 57, comprising power means for powering the conveyor means.

59. A man-over-board recovery ramp according to clause 58, wherein the power means for powering the conveyors comprises a motor mounted on the mounting and drivingly connected to the belts via the rollers.

60. A man-over-board recovery ramp according to clause 58, wherein the power means for powering the conveyors comprises a motor arranged internally of at least one of the rollers.

61. A man-over-board recovery ramp according to clause 60, wherein the first conveyor section and the second conveyor section each have a motor internal to a roller thereof.

62. A man-over-board recovery ramp according to any of clauses 53 to 61, wherein the means for normally stowing the first and second conveyor sections comprises lashings for lashing the first and second conveyor sections upright, wherein the first and second conveyor sections are able to deploy by gravity under control of a winch, 63. A man-over-board recovery ramp according to clause 62, comprising a spring, optionally a gas strut, to urge the second conveyor section from lying close to the first conveyor section.

64. A man-over-board recovery ramp according to clause 62 or 63, comprising a linkage connected to the first and second conveyor sections, wherein the linkage is arranged such that as the first conveyor section deploys and angles away from an upright stowage position, the second conveyor section deploys with an opposite angle of rotation.

65. A man-over-board recovery ramp according to any of clauses 53 to 64, wherein the distal end of the second conveyor section has buoyancy for supporting the second conveyor section in the water.

66. A man-over-board recovery ramp according to any of clauses 53 to 65, wherein the first and second conveyor sections are configured to deploy under the control of a powered actuator, optionally a powered winch.

67. A man-over-board recovery ramp according to any of clauses 53 to 66, wherein the recovery ramp is configured to be retrofitted to an existing boat.

68. A man-over-board recovery ramp according to any of clauses 53 to 67, wherein the ramp is configured to be fitted to the boat during building of the boat.

69. A man-over-board recovery ramp according to any of clauses 53 to 68, wherein the mounting is configured to be fitted with the pivot axis athwart-ship at the stern of the boat.

70. A man-over-board recovery ramp according to any of clauses 53 to 69, wherein the mounting is a unitary mounting.

71. A man-over-board recovery ramp according to any of clauses 53 to 69, wherein the mounting comprises a pair of independent fittings, optionally plumber blocks, adapted to be fitted separately to the boat.

72. A man-over-board recovery ramp according to any of clauses 53 to 71, wherein the mounting is configured to be fitted to a deck of the boat.

73. A man-over-board recovery ramp according to any of clauses 53 to 72, wherein the mounting is configured to be movably stowed in a position that is spaced from a deployment position which is positioned centrally of a transom of the boat.

74. A man-over-board recovery ramp according to clause 73, wherein the mounting is configured to be arranged on rails to move sideways with the stowed ramp, optionally from a position against stern rails to port or starboard of a central board position in the stern rails.

75. A man-over-board recovery ramp according to clause 74, wherein the mounting and the stowed ramp are configured to be stowed against a port or starboard side rail and are configured to be pivotally connected to a post common to stern rails and side rails such that the ramp is pivotal to a transom deployment position.

76. A man-over-board recovery ramp according to any of clauses 53 to 75, wherein the ramp is configured to be fitted to a boat such that in the deployment position the ramp is amidships.

77. A man-over-board recovery ramp according to any of clauses 53 to 76, wherein the first and second conveyor sections each comprise pressed steel side members.

78. A man-over-board recovery ramp according to clause 77, comprising a respective panel fixed between the side members of each of the first and second conveyor sections, wherein each panel is a lower panel when the ramp is deployed and in use.

79. A man-over-board recovery ramp according to clause 78, wherein each of the panels are apertured.

80. A man-over-board recovery ramp according to clause 78 or 79, wherein each of the panels have low-friction strips for a belt to slide on.

81. A man-over-board recovery ramp according to clause 78, 79 or 80, wherein the panel of the first conveyor section and the panel of the second conveyor section are connected together with hinge formations through which a shaft extends.

82. A man-over-board recovery ramp according to clause 81, comprising hinge-stop plates fixed to each of the side members and arranged to prevent the first conveyor section and the second conveyor section sagging once deployed.

83. A man-over-board recovery ramp according to clause 82, wherein the hinge-stop plates carry latches for holding the first and second conveyor sections in alignment once deployed.

84. A man-over-board recovery ramp according to any of clauses 81 to 83, wherein the side members are each provided with buoyant guides that extend along the side members from the hinge formations.

85. A man-over-board recovery ramp according to any of clauses 77 to 84, wherein the side members each comprise flanges that extend inwardly and that define a belt run channel, and wherein two further panels that are upper panels when the ramp is deployed and in use are fixed between the side members on each of the first and second conveyor sections, respectively.

86. A man-over-board recovery ramp according to clause 85, wherein each further panel comprises low-friction strips for a belt to slide on.

87. A man-over-board recovery ramp according to clause 85 or 86, wherein each further panel has a spaced end.

88. A man-over-board recovery ramp according to any of clauses 53 to 87, wherein the conveyor means comprising a belt comprised of interdigitated, hinged pieces, some of which have slat members standing up from the belt.

89. A man-over-board recovery ramp according to any of clauses 53 to 88, wherein the proximal end of the first conveyor section comprises a shaft, wherein the mounting comprises two plumber blocks through which the shaft runs, and wherein a belt driven motor is provided at one end of the shaft.

90. A man-over-board recovery ramp according to clause 89, comprising a control box via which the belt driven motor can be switched on.

91. A vessel, for example a boat, optionally a life boat, comprising the man-over-board recovery ramp according to any of clauses 53 to 90.

92. A vessel according to clause 91, wherein the man-over-board recovery ramp has been retrofitted to the boat or wherein the recovery ramp is integrally fitted with the boat.

The invention claimed is:

1. A man-over-board recovery ramp for fitting to a boat, comprising:

a mounting adapted to be fitted to the boat, the mounting defining a pivot axis, wherein the recovery ramp is arranged to pivot around the pivot axis to a deployed position;

a first conveyor section connected to the mounting and arranged to pivot around the pivot axis, wherein the first conveyor section is slidably connected to the mounting or wherein the mounting is configured to be slidably connected to the boat such that the recovery ramp is slidable into a stowed position; and conveyor means on the first conveyor section for drawing a man-over-board casualty up the ramp.

2. A man-over-board recovery ramp according to claim 1, wherein in the deployed position a distal end of the recovery ramp is configured to extend to or through a waterline of the boat to which the ramp is to be fitted to thereby permit drawing of the man-over-board casualty in the water up the ramp.

3. A man-over-board recovery ramp according to claim 1, wherein the recovery ramp is arranged to slide and pivot in unison/in concert/simultaneously as it moves from the stowed position and into the deployed position.

4. A man-over-board recovery ramp according to claim 1, wherein the recovery ramp is prevented from pivoting around the pivot axis whilst the ramp is in the stowed position.

5. A man-over-board recovery ramp according to claim 1, wherein the mounting is configured to be arranged on rails on the boat which enables the recovery ramp to slide into the stowed position.

6. A man-over-board recovery ramp according to claim 1, wherein in the stowed position the recovery ramp is configured to be stowed, either wholly or partly, within a footprint of the boat to which the ramp is to be fitted.

7. A man-over-board recovery ramp according to claim 1, wherein the recovery ramp is arranged to pivot to the deployed position and/or from the stowed position under the effect of gravity.

8. A man-over-board recovery ramp according to claim 7, comprising a winch that is arranged to control the recovery ramp as it pivots to the deployed position and/or from the stowed position.

9. A man-over-board recovery ramp according to claim 1, wherein a distal end of the recovery ramp is provided with buoyancy arranged to maintain the distal end of the recovery ramp at a predetermined depth in the water in the deployed position.

10. A man-over-board recovery ramp for fitting to a boat, comprising:

a mounting adapted to be fitted to the boat, the mounting defining a pivot axis;

a first conveyor section connected to the mounting and arranged to pivot around the pivot axis, wherein a distal end of the recovery ramp is provided with ballast arranged to maintain the distal end of the recovery ramp at a predetermined depth in the water in a deployed position; and conveyor means on the first conveyor section for drawing a man-over-board casualty up the ramp.

11. A man-over-board recovery ramp according to claim 1, wherein the ramp comprises isolation means for isolating motion of a distal end of the recovery ramp from motion of the boat to which the ramp is to be fitted, wherein the means for isolating motion comprises one or more floatation devices attached to or forming part of the recovery ramp and configured to support the distal end of the recovery ramp in the water.

12. A man-over-board recovery ramp according to claim 1, wherein the recovery ramp is configured be retrofitted to an existing boat.

13. A man-over-board recovery ramp according to claim 1, wherein the ramp is configured be integrated with the boat during its construction.

14. A man-over-board recovery ramp according to claim 1, wherein the recovery ramp has an open or aperture structure which permits water to flow through the ramp.

15. A man-over-board recovery ramp according to claim 1, wherein the conveyor means comprises projections extending from a surface of the conveyor means.

16. A man-over-board recovery ramp according to claim 1, wherein the conveyor means is arranged to create a current in the water when used to help draw the man-over-board casualty up the recovery ramp, wherein the current urges the man-over-board casualty in the water towards the recovery ramp.

17. A man-over-board recovery ramp according to claim 1, wherein the material of the conveyor means is advantageously tacky or otherwise has an enhanced frictional surface.

18. A man-over-board ramp recovery according to claim 1, wherein the mounting is configured to be fitted with the pivot axis athwart-ship at a stern of the boat or at a bow of the boat.

19. A man-over-board recovery ramp according to claim 1, wherein the recovery ramp is configured to be fitted to the boat such that in the deployed position the ramp is amidships.

20. A man-over-board recovery ramp according to claim 1, wherein a proximal end of the first conveyor section comprises a shaft and wherein the mounting comprises two plumber blocks through which the shaft runs.

21. A man-over-board recovery ramp according to claim 1, wherein the mounting is configured to be fitted to a transom, a gunwale, a deck, a bow or a stern of the boat.

22. A method of recovering a man-over-board using a boat fitted with the man-over-board recovery ramp of claim 1, the method comprising:

pivoting the first conveyor section around the pivot axis from the stowed position to the deployed position; and drawing the man-over-board casualty up the ramp using the conveyor means.

23. A vessel comprising the man-over-board recovery ramp according to claim 1.

24. A man-over-board recovery ramp according to claim 1, wherein the first conveyor section has a proximal end and a distal end, the first conveyor section is pivotally attached to the mounting at the pivot axis at the proximal end of the first conveyor section, and wherein the man-over-board recovery ramp comprises:

a second conveyor section pivotally attached to the first conveyor section about a second pivot axis at the distal end of the first conveyor section and a proximal end of the second conveyor section, whereby the first conveyor section and the second conveyor section can lie close to each other when not deployed;

means for restricting angular movement of the first conveyor section and the second conveyor section away from lying close to each other to relative orientations wherein they extend away from each other;

means for normally stowing the first conveyor section and the second conveyor section lying close to each other and extending upwards of the mounting and for releasing them for deployment to a position in which the first conveyor section slopes downwards from the mounting and the second conveyor section extends away from the first; and wherein the conveyor means on the first conveyor section and a conveyor means provided on the second conveyor section are suitable for drawing the man-over-board casualty up the ramp.

* * * * *